US010004343B1

(12) United States Patent
Mesguich

(10) Patent No.: US 10,004,343 B1
(45) Date of Patent: Jun. 26, 2018

(54) SHOP WINDOW MANNEQUIN HEAD THAT IS EASIER TO CUSTOMIZE

(71) Applicant: MOULAGES ET ARTS PLASTIQUES INDUSTRIELS (MAPI), Le Broc (FR)

(72) Inventor: Jean-Marc Mesguich, Lyons (FR)

(73) Assignee: MOULAGES ET ARTS PLASTIQUES INDUSTRIELS (MAPI), Le Broc (FR)

( * ) Notice: Subject to any disclaimer, the term of this patent is extended or adjusted under 35 U.S.C. 154(b) by 259 days.

(21) Appl. No.: 15/105,147

(22) PCT Filed: Dec. 1, 2014

(86) PCT No.: PCT/FR2014/053091

§ 371 (c)(1),
(2) Date: Jun. 16, 2016

(87) PCT Pub. No.: WO2015/092189

PCT Pub. Date: Jun. 25, 2015

(30) Foreign Application Priority Data

Dec. 16, 2013 (FR) ..... 13 62722

(51) Int. Cl.
*A47F 8/00* (2006.01)
*A63H 3/36* (2006.01)
*A63H 3/48* (2006.01)

(52) U.S. Cl.
CPC ..... *A47F 8/00* (2013.01); *A63H 3/36* (2013.01); *A63H 3/48* (2013.01); *A63H 3/365* (2013.01)

(58) Field of Classification Search
CPC .... A47F 8/00; A62H 3/16; A62H 3/36; A62H 3/365; A62H 3/38; A62H 3/40; A62H 3/42; A62H 3/48; G09F 19/08; G09F 19/088; Y10S 428/90
See application file for complete search history.

(56) References Cited

U.S. PATENT DOCUMENTS 3,090,155 A * 5/1963 Gordon ..... A63H 33/26 428/900
3,210,884 A 10/1965 Sharff et al.
3,616,572 A * 11/1971 Kisuchi et al. ..... A63H 3/40 446/346
4,596,528 A * 6/1986 Lewis ..... G09B 23/30 434/270
6,187,041 B1 * 2/2001 Garonzik ..... A61F 2/141 623/4.1

(Continued)

*Primary Examiner* — Ismael Izaguirre
(74) *Attorney, Agent, or Firm* — Occhiuti & Rohlicek LLP

(57) ABSTRACT

A mannequin head with a part having an outer surface appearing like an eye/mouth. A guide stub extends from an inner surface and one orifice is in the outer surface and has a first section. There is a second section extending from the shoulder and a holding device comprising a first magnetized element and a second element with a magnetic force. The guide stub extends from the inner surface to a depth at least equal to 4 mm and a cross section of at least 2 $cm^2$. The first section extends from the outer surface to the shoulder to approximately to 4 mm in depth and the second section comprises a threaded portion. The screw is inserted in threaded portion of the second section and one of the elements of the holding device is attached to the guide stub and the other is secured to the screw.

10 Claims, 2 Drawing Sheets

(56) References Cited

U.S. PATENT DOCUMENTS

| | | | | |
|---|---|---|---|---|
| 8,298,037 | B2 * | 10/2012 | Sip | A63H 3/40 446/343 |
| 2013/0186922 | A1 * | 7/2013 | Soto Velasco | A47F 8/00 223/66 |
| 2016/0101338 | A1 * | 4/2016 | Daniels | A63B 69/34 482/8 |

* cited by examiner

Fig. 4
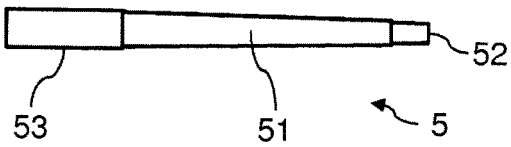
Fig. 5
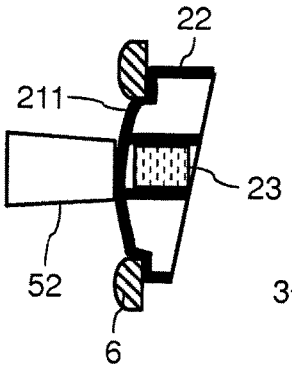
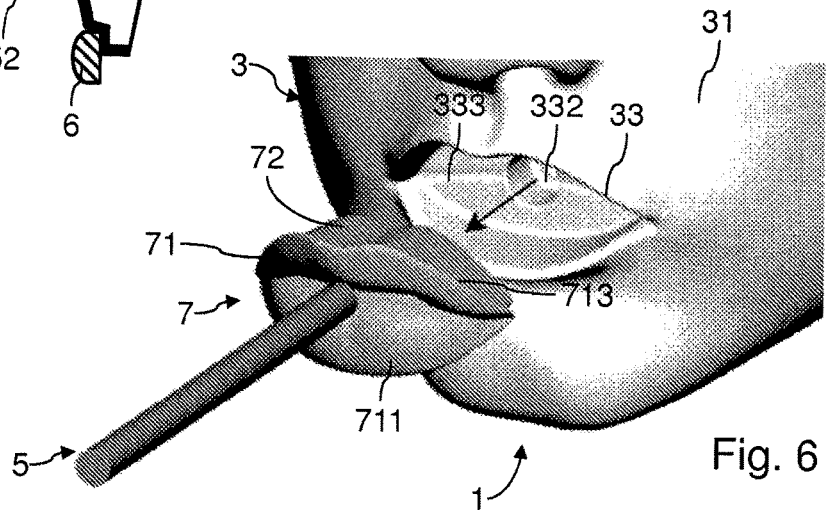
Fig. 6
Fig. 7
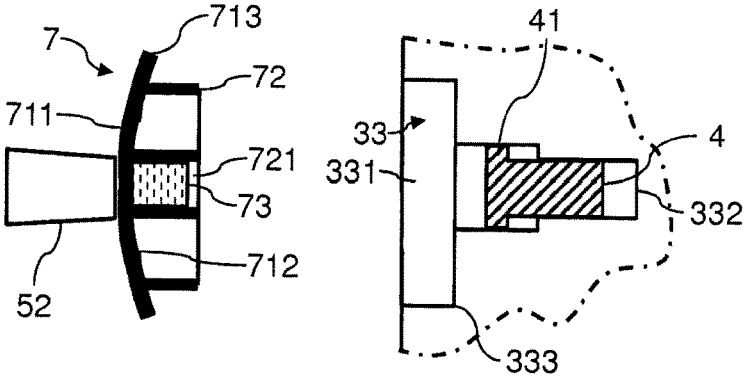

SHOP WINDOW MANNEQUIN HEAD THAT IS EASIER TO CUSTOMIZE

RELATED APPLICATIONS

This is the national stage, under 35 USC 371, of PCT application PCT/FR2014/053091, filed on Dec. 1, 2014, which claims the benefit of the Dec. 16, 2013 priority date of French Application 1362722, the content of which is herein incorporated by reference.

FIELD OF INVENTION

The invention relates to shop window mannequins, and in particular mannequins provided with a head which one wishes to be able to customize.

BACKGROUND

In order to display clothing, it is sometimes desirable to have shop window mannequins which make it possible to show these clothes to best effect. In order to make a shop window mannequin more lifelike, it is often provided with a head. In order to show the clothes to best effect, it is desirable to be able to customize the head of the shop window mannequin, in order to be able to adapt it to the clothes arranged on the body of the mannequin. Thus, shop window mannequins comprising removable and interchangeable eyes or mouth are known in order to permit the use of different shapes, different colours or different make up aspects simply by replacing these. Such mannequin heads thus make it possible to create a great degree of customization simply by creating new models of eyes or mouth, and thus without it being necessary to change the design of the entire head of the mannequin.

To date, there is no satisfactory solution by means of which it is possible to provide, at the same time:

good support for the affixed part;

rapid and damage-free separation of the affixed part from the head;

satisfactory appearance of the assembly of the part and the head.

SUMMARY OF INVENTION

The invention aims to solve one or more of these drawbacks. Thus, the invention relates to a shop window mannequin head as defined in the appended claims.

The invention also relates to a system including a mannequin head as defined previously, and to a stylus comprising a permanent magnet attached to one of its ends.

Other features and advantages of the invention will become clear from the indicative and entirely non-limiting description thereof hereinbelow, with reference to the appended drawings.

BRIEF DESCRIPTION OF THE DRAWINGS

FIG. 4 is a side view of an exemplary stylus designed for manipulating a customization part;

FIG. 5 is a view in section of one end of a stylus during manipulation of a customization part;

FIG. 6 shows an exploded perspective view of part of a shop window mannequin head according to the invention, provided with a customization mouth;

FIG. 7 is a view in cross section of a mouth prior to fitting to the head using a stylus.

DETAILED DESCRIPTION

Figure 1:
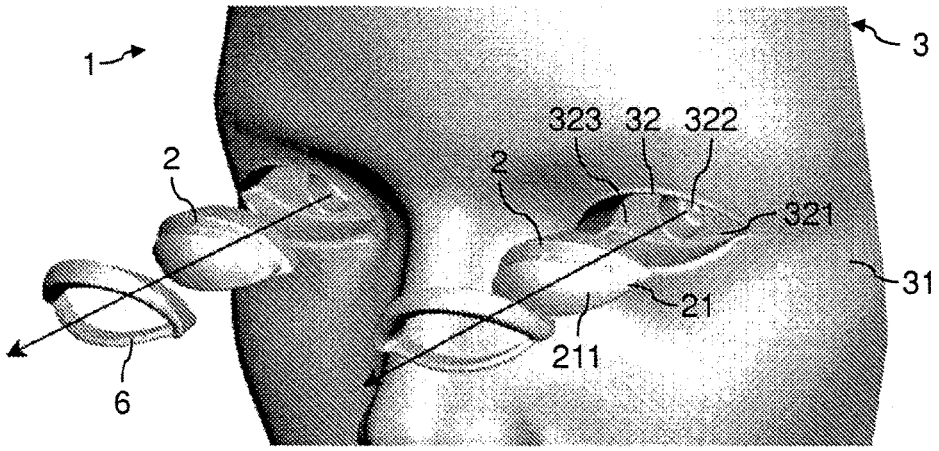
FIG. 1 shows an exploded perspective view of a portion of a shop window mannequin head according to the invention, provided with two customization eyes.

FIG. 1 is an exploded perspective view of an upper portion of a shop window mannequin head 1. The head 1 comprises two customization parts 2, in this case two removable eyes. The head 1 also comprises a support 3 having an outer surface 31 in the shape of a face.

The support 3 comprises, for example, a shell made of synthetic material, of which the outer surface 31 is in the shape of a face. Such a shell made of synthetic material may, for example, be injection-molded. At the locations of the eyes of the face, orifices 32 are created in the outer surface 31.

Figure 2:
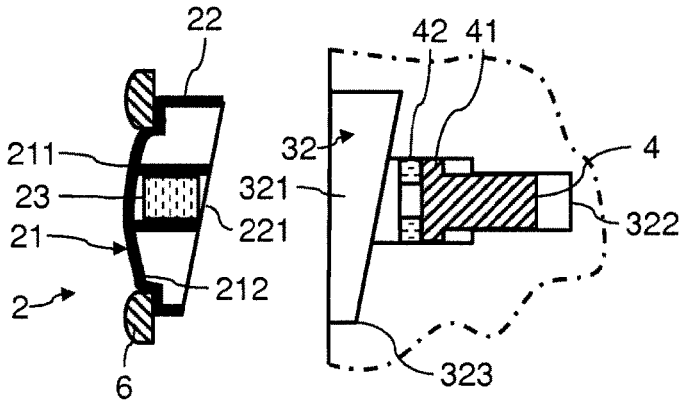
FIG. 2 is a view in cross section of an eye prior to fitting to the head.

As can be seen more clearly in the view in cross section of FIG. 2 (configuration in which the eye 2 is not secured to the support 3), each orifice 32 comprises a first section 321 extending from the outer surface 31 to a shoulder 323. This first section 321 forms a cavity designed to guide and receive the eye 2. The depth of the first section 321 is at least equal to 4 mm, and preferably at least equal to 6 mm, in order to optimally guide and hold the eye 2 in this first section 321. Each orifice 32 also has a second section 322 extending from the shoulder 323. The section 322 comprises a threaded cylindrical surface. In the example shown, the section 322 is in two portions and comprises a first, larger diameter non-threaded portion and a second, smaller diameter threaded portion.

A screw 4 is screwed into the threaded portion of the second section 322. The screw 4 comprises an actuating head 41 accommodated in the first, non-threaded portion of the section 322. A permanent magnet 42 is in this case attached to the head 41 of the screw 4. A central bore is advantageously created in the permanent magnet 42, in order to allow access to the recess of the screw head 41. A drive recess may of course also be created in the permanent magnet 42.

The eye 2 comprises a wall 21 of which the outer surface 211 does indeed have the appearance of an eye. The wall 21 also has an inner surface 212. A guide stub 22 (in this case hollow) extends, in a longitudinal direction, from the inner surface 212 to a depth at least equal to 4 mm (and preferably at least equal to 6 mm). This guide stub 22 also has a cross section area at least equal to 2 $cm^2$ (and preferably at least equal to 3 $cm^2$). The cross section of the guide stub 22 matches or is complementary to the cross section of the first section 321 of the orifice 32. These matching shapes ensure good positioning between the guide stub 22 and the first section 321. In addition, if these matching shapes are non-circular, the eye 2 is prevented from pivoting relative to the orifice 32 about a longitudinal axis. By virtue of such a depth of the guide stub 22, the eye 2 is better held and positioned with respect to the support 3. Such a cross section of the guide stub 22 favors good positioning of the eye 2 with respect to the support 3, such that it is possible to use an eye 2 with a relatively large outer surface 211, without the risk of an obvious positioning error. For example, such a cross section of the stub 22 proves to be particularly advantageous when the cross section area of the outer surface 211 is at least equal to 4 $cm^2$. Such a cross section of the stub 22 proves to be very particularly advantageous when an element (representing make-up, for example) is as one with the eye 2 and has to cover a significant area of the outer surface 31 of the support 3.

The stub 22 comprises a bore 221 in its central portion. A permanent magnet 23 is encased within this bore 221.

When the stub 22 is inserted into the orifice 32, the increased mutual proximity of the permanent magnet 23 and the permanent magnet 42 generates an attractive force between them. The combination of these permanent magnets 23 and 42 forms a device for holding the eye 2. Such a device for holding the eye then comprises at least one permanent magnet and one other element subjected to an attractive force by the permanent magnet, one being secured to the eye 2 and the other being secured to the screw 4.

Figure 3:
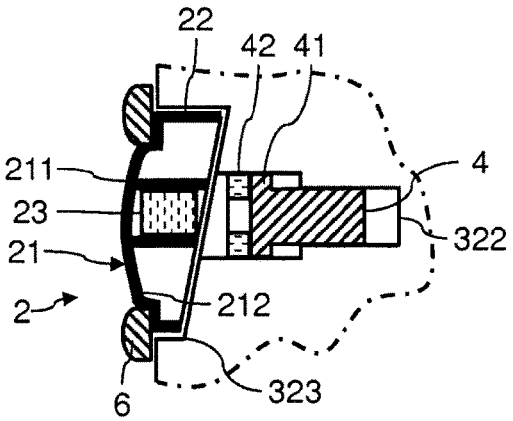
FIG. 3 is a view in cross section of an eye after fitting to the head.

FIG. 3 shows a configuration in which the stub 22 of the eye 2 is accommodated in the orifice 32. In this configuration, the stub 22 abuts against the shoulder 323 in order to define its longitudinal position with respect to the support 3.

Screwing or unscrewing the screw 4 shifts the longitudinal position of the permanent magnet 42 relative to the shoulder 323. This changes the attractive force of this permanent magnet 42 relative to the permanent magnet 23 of the customization eye 2. In order to have a large range for adjusting the attractive force of the device for holding the eye 2, the threaded portion created in the section 322 is advantageously at least 10 mm long, in order to ensure sufficient travel for the screw 4.

In the example shown in FIGS. 1 to 3, the eye 2 also comprises an affixed eyelid 6. This affixed eyelid 6 for example fits around the outer surface 211. This affixed eyelid 6 may form a peripheral transverse projection with respect to the guide stub 22. This peripheral projection may for example cover some of the outer surface 31 of the support 3.

The wall 21 may also extend transversely beyond the stub 22 to form an equivalent peripheral transverse projection. Such a peripheral transverse projection may advantageously be at least 3 mm wide, in order to properly hide the edge of the orifice 32.

The invention proves particularly advantageous for fitting/removing an eye 2 to/from the support 3 using a magnetic stylus 5, shown in FIG. 4. Such a magnetic stylus 5 comprises, for example, a stem 51 provided with a gripping region 53 at one end and comprising a permanent magnet 52 attached to another end of the stem 51.

The use of such a stylus 5 makes it possible to fit and/or remove an eye 2 very rapidly and with minimal risk of damage to the eye 2 and its decoration, for example by scratching.

For fitting, the magnet 52 of the stylus 5 can be positioned against the outer surface 111 of the eye 2, in line with the magnet 23. The eye 2 is secured to the stylus 5 by mutual attraction of the magnets 52 and 23, as shown in FIG. 5. The stub 22 of the eye 2 is then inserted into the cavity 32. The magnet 42 then exerts an attractive force on the magnet 23. In order to ensure that the eye 2 is held in the cavity 32, the attraction of the magnet 52 on the element 23 is reduced by pivoting the stylus 5 about a transverse axis.

In order to ensure maximum attractive force between the magnet 52 and the magnet 23 (with a magnet 23 of reasonable dimensions), the distance between the outer surface 211 of the eye 2 and the magnet 23 is advantageously less than 4 mm.

FIG. 6 is an exploded perspective view of a lower portion of the shop window mannequin head 1. The head 1 comprises a customization part 7, in this case a removable mouth. Here, the head 1 comprises the same support 3 as set out previously. This support 3 thus has an outer surface 31 in the form of a face.

At the location of the mouth of the face, an orifice 33 is created in the outer surface 31.

As can be seen more clearly in the view in cross section of FIG. 7 (configuration in which the mouth 7 is not secured to the support 3), the orifice 33 comprises a first section 331 extending from the outer surface 31 to a shoulder 333. This first section 331 forms a cavity designed to guide and receive the mouth 7. The depth of the first section 331 is at least equal to 4 mm, and preferably at least equal to 6 mm, in order to optimally guide and hold the mouth 7 in this first section 331. The orifice 33 also has a second section 332 extending from the shoulder 333. The section 332 comprises a threaded cylindrical surface. In the example shown, the section 332 is in two portions and comprises a first, larger diameter non-threaded portion and a second, smaller diameter threaded portion.

A screw 4 is screwed into the threaded portion of the second section 332. The screw 4 comprises an actuating head 41 accommodated in the first, non-threaded portion of the section 332.

The mouth 7 comprises a wall 71 of which the outer surface 711 does indeed have the appearance of a mouth. The wall 71 also has an inner surface 712. A guide stub 72 (in this case hollow) extends, in a longitudinal direction, from the inner surface 712 to a depth at least equal to 4 mm (and preferably at least equal to 6 mm). This guide stub 72 also has a cross section area at least equal to 2 $cm^2$ (and preferably at least equal to 3 $cm^2$). The cross section of the guide stub 72 matches the cross section of the first section 331 of the orifice 33. These matching shapes ensure good positioning between the guide stub 72 and the first section 331. In addition, if these matching shapes are non-circular, the mouth 7 is prevented from pivoting relative to the orifice 33 about a longitudinal axis. By virtue of such a depth of the guide stub 72, the mouth 7 is better held and positioned with respect to the support 3. Such a cross section of the guide stub 72 favors good positioning of the mouth 7 with respect to the support 3, such that it is possible to use a mouth 7 with a relatively large outer surface 711, without the risk of an overly obvious positioning error. For example, such a cross section of the stub 72 proves to be particularly advantageous when the cross section area of the outer surface 711 is at least equal to 4 $cm^2$. Such a cross section of the stub 72 proves to be very particularly advantageous when an element (representing make-up, for example, and as one with the mouth 7) has to cover a significant area of the outer surface 31 of the support 3.

The stub 72 comprises a bore 721 in its central portion. A permanent magnet 73 is encased within this bore 721. When the stub 72 is inserted into the orifice 33, the increased mutual proximity of the permanent magnet 73 and the screw head 41 generates an attractive force between them. The combination of the permanent magnet 73 and the screw head 41 forms a device for holding the mouth 7.

In a manner similar to the preceding example, screwing or unscrewing the screw 4 shifts the longitudinal position of the screw head 41 relative to the shoulder 333. This modifies the attractive force between the screw head 41 and the permanent magnet 73 of the customization mouth 7.

The invention claimed is:

1. A shop window mannequin head, comprising:

a customization part comprising:

a wall having an outer surface with the appearance of an eye or of a mouth, and having an inner surface;

a guide stub extending from the inner surface in a longitudinal direction;

a support having an outer surface in the form of a face, at least one orifice being created in the outer surface at the location of an eye or a mouth of the face, the orifice comprising:

a first section extending from the outer surface as far as a shoulder and having a cross section area that matches the cross section area of the guide stub;

a second section extending from the shoulder;

a holding device comprising a first, permanently magnetized element and a second element subjected to a magnetic attraction force close to the first element;

wherein:

the guide stub extends from the inner surface to a depth at least equal to 4 mm in a longitudinal direction, and comprises a cross section area at least equal to 2 $cm^2$;

the first section extends from the outer surface as far as the shoulder to a depth at least equal to 4 mm;

the second section comprises a threaded portion;

a screw is screwed into the threaded portion of the second section;

one of the elements of the holding device is attached to the guide stub and the other of these elements is secured to said screw.

2. The shop window mannequin head as claimed in claim 1, in which said first, permanently magnetized element is attached to the guide stub.

3. The shop window mannequin head as claimed in claim 1 in which the distance between the outer surface of the customization part and said element attached to the guide stub is less than 4 mm.

4. The shop window mannequin head as claimed in claim 1, in which said second element comprises permanent magnetization and is attached to a head of the screw.

5. The shop window mannequin head as claimed in claim 1, in which said screw is made of steel and in which said second element is formed by a head of this screw.

6. The shop window mannequin head as claimed in claim 1, in which said guide stub has a non-circular cross section.

7. The shop window mannequin head as claimed in claim 1, in which said outer surface has a cross section area at least equal to 4 $cm^2$.

8. The shop window mannequin head as claimed in claim 1, in which said wall of the customization part forms a peripheral transverse projection that is at least 3 mm wide with respect to said guide stub.

9. The shop window mannequin head as claimed claim 1, in which the length of said threaded portion is at least equal to 10 mm.

10. A system including a mannequin head as claimed in claim 1, further including a stylus comprising a permanent magnet attached to one of its ends.

* * * * *